US008241759B2

(12) United States Patent
Nakagaito et al.

(10) Patent No.: US 8,241,759 B2
(45) Date of Patent: Aug. 14, 2012

(54) ZINC-PLATED HIGH-TENSION STEEL SHEET EXCELLENT IN PRESS FORMABILITY

(75) Inventors: Tatsuya Nakagaito, Tokyo (JP); Yoshitsugu Suzuki, Tokyo (JP); Shusaku Takagi, Tokyo (JP); Saiji Matsuoka, Tokyo (JP); Takashi Kawano, Tokyo (JP)

(73) Assignee: JFE Steel Corporation (JP)

( * ) Notice: Subject to any disclaimer, the term of this patent is extended or adjusted under 35 U.S.C. 154(b) by 424 days.

(21) Appl. No.: 12/532,452

(22) PCT Filed: Mar. 18, 2008

(86) PCT No.: PCT/JP2008/055629

§ 371 (c)(1),
(2), (4) Date: Sep. 22, 2009

(87) PCT Pub. No.: WO2008/123267

PCT Pub. Date: Oct. 16, 2008

(65) Prior Publication Data

US 2010/0104891 A1 Apr. 29, 2010

(30) Foreign Application Priority Data

Mar. 22, 2007 (JP) ..... 2007-074656
Jan. 31, 2008 (JP) ..... 2008-020772

(51) Int. Cl.
*B32B 15/04* (2006.01)
*B32B 15/18* (2006.01)

(52) U.S. Cl. ..... 428/659; 428/684; 428/336

(58) Field of Classification Search ..... 428/659, 428/658, 682, 684, 336, 332
See application file for complete search history.

(56) References Cited

U.S. PATENT DOCUMENTS 5,677,005 A * 10/1997 Isobe et al. ..... 427/319
7,527,700 B2 5/2009 Kariya et al.
2006/0096678 A1 5/2006 Kariya
2007/0190353 A1 8/2007 Taniguchi et al.

FOREIGN PATENT DOCUMENTS

| | | | | |
|---|---|---|---|---|
| EP | 1 616 970 | A1 | | 1/2006 |
| EP | 1 724 371 | A1 | | 11/2006 |
| JP | 2001-192768 | A | | 7/2001 |
| JP | 2001-207235 | | * | 7/2001 |
| JP | 2001-207235 | A | | 7/2001 |
| JP | 2004-339606 | A | | 12/2004 |
| JP | 2005-002404 | A | | 1/2005 |
| JP | 2005-163055 | A | | 6/2005 |
| JP | 2005-200690 | A | | 7/2005 |
| JP | 2005-200694 | A | | 7/2005 |
| JP | 2005-256089 | A | | 9/2005 |
| JP | 2005-264328 | A | | 9/2005 |
| JP | 2006-299344 | A | | 11/2006 |
| JP | 2007-002276 | A | | 1/2007 |
| JP | 2007-302918 | A | | 11/2007 |
| WO | 2004/094681 | A1 | | 11/2004 |
| WO | 2005/087965 | A1 | | 9/2005 |

OTHER PUBLICATIONS

Machine Translation, Osawa et al., JP 2001-207235, Jul. 2001.*

T. Ohmura et al., "Investigation on a Relationship Between Microstructures and Mechanical Properties of Martensite Using Nanoindentation Techniques," *Proceedings of the International Workshop on the Innovative Structural Materials for Infrastructure in 21st Century*, Frontier Research Center for Structural Materials, National Research Institute for Metals, Jan. 12-13, 2000, pp. 185-194.

* cited by examiner

*Primary Examiner* — Michael La Villa
(74) *Attorney, Agent, or Firm* — DLA Piper LLP (US)

(57) ABSTRACT

A high-strength galvanized steel sheet having excellent formability contains as a chemical component of steel on a mass percent basis: 0.05% to 0.3% of C; more than 0.60% to 2.0% of Si; 0.50% to 3.50% of Mn; 0.003% to 0.100% of P; 0.010% or less of S; 0.010% to 0.06% of Al; 0.007% or less of N; and the balance including Fe and inevitable impurities, and in the microstructure of the steel sheet, the standard deviation of nano-hardness is 1.50 GPa or less.

14 Claims, No Drawings

ZINC-PLATED HIGH-TENSION STEEL SHEET EXCELLENT IN PRESS FORMABILITY

RELATED APPLICATIONS

This is a §371 of International Application No. PCT/JP2008/055629, with an international filing date of Mar. 18, 2008 (WO 2008/123267 A1, published Oct. 16, 2008), which is based on Japanese Patent Application Nos. 2007-074656, filed Mar. 22, 2007, and 2008-020772, filed Jan. 31, 2008.

TECHNICAL FIELD

This disclosure relates to a high-strength galvanized steel sheet having excellent formability, which is for members used, for example, in automobile and electrical industrial fields.

BACKGROUND

In recent years, in view of global environment conservation, to improve fuel efficiency of automobiles and to improve collision safety of automobiles, development has been aggressively carried out to reduce the wall thickness of automobiles by increasing the strength of materials therefor so as to reduce the weight of the automobile body itself and to increase the strength thereof, and hence high tensile strength steel sheets have been increasingly used in automobile applications. Since the high tensile strength steel is inferior in formability to soft steel, a high tensile strength steel sheet having improved formability has been developed through various structure controls. Furthermore, since improvement in corrosion resistance has been strongly requested for recent automobiles, a high tensile steel sheet processed by hot-dip galvanizing has been developed.

As a conventional technique, for example, Japanese Unexamined Patent Application Publication No. 2005-256089 has proposed a high-strength hot-dip plated steel sheet having excellent hole expansion properties, and Japanese Unexamined Patent Application Publication Nos. 2005-200690, 2005-200694 and 2006-299344 have proposed a high-strength hot-dip plated steel sheet having an excellent anti-powdering property and ductility.

However, to ensure a high strength of TS 590 Mpa or more, according to the techniques described above, it is necessary to add 0.25% or more of Al, and hence there have been problems of alloying cost, degradation in casting properties caused by Al addition, and the like. In addition, in particular, according to Japanese Unexamined Patent Application Publication Nos. 2005-200690, 2005-200694 and 2006-299344, since retained austenite is contained, although the steel sheet has high elongation properties, cracking may occur in secondary machining, and/or shape fixability of formed parts may be inferior to that of ferrite/martensite steel in some cases.

In consideration of the problems described above, it could be helpful to obtain a high-strength galvanized steel sheet, which has excellent formability equivalent or superior to that of a conventional high-strength galvanized steel sheet, which is manufactured at a cost equivalent to a conventional high-strength galvanized steel sheet, and which has manufacturing properties equivalent to those thereof, and a method for manufacturing the above steel sheet.

SUMMARY

We provide:

(1) A high-strength galvanized steel sheet having excellent formability, which comprises, as a chemical component of steel on a mass percent basis: 0.05% to 0.3% of C; more than 0.60% to 2.0% of Si; 0.50% to 3.50% of Mn; 0.003% to 0.100% of P; 0.010% or less of S; 0.010% to 0.06% of Al; 0.007% or less of N; and the balance including Fe and inevitable impurities, wherein in the microstructure of the steel sheet, the standard deviation of nano-hardness is 1.50 GPa or less.

(2) A high-strength galvanized steel sheet having excellent formability, which comprises, as a chemical component of steel on a mass percent basis: 0.05% to 0.3% of C; more than 0.60% to 2.0% of Si; 0.50% to 3.50% of Mn; 0.003% to 0.100% of P; 0.010% or less of S; 0.010% to 0.06% of Al; 0.007% or less of N; and the balance including Fe and inevitable impurities, wherein in the microstructure of the steel sheet, ferrite has an area fraction of 20% or more, tempered martensite, tempered bainite, and bainite have a total area fraction of 10% or more, ferrite, tempered martensite, tempered bainite, and bainite have a total area fraction of 90% or more, and the standard deviation of nano-hardness is 1.50 GPa or less.

(3) The high-strength galvanized steel sheet having excellent formability, according to the above (1) or (2), wherein the steel described in the above (1) or (2) further comprises at least one of 0.005% to 2.00% of Cr, 0.005% to 2.00% of V, 0.005% to 2.00% of Mo, 0.005% to 2.00% of Ni, and 0.005% to 2.00% of Cu on a mass percent basis.

(4) The high-strength galvanized steel sheet having excellent formability, according to one of the above (1) to (3), wherein the steel described in one of the above (1) to (3) further comprises at least one of 0.01% to 0.20% of Ti and 0.01% to 0.10% of Nb on a mass percent basis.

(5) The high-strength galvanized steel sheet having excellent formability, according to one of the above (1) to (4), wherein the steel described in one of the above (1) to (4) further comprises 0.0002% to 0.005% of B on a mass percent basis.

(6) The high-strength galvanized steel sheet having excellent formability, according to one of the above (1) to (5), wherein the steel described in one of the above (1) to (5) further comprises at least one of 0.001% to 0.005% of Ca and 0.001% to 0.005% of REM on a mass percent basis.

(7) The high-strength galvanized steel sheet having excellent formability, according to one of the above (1) to (6), wherein in the microstructure of the steel sheet, the total area fraction of retained austenite and martensite is 5% or less.

(8) The high-strength galvanized steel sheet having excellent formability according to one of the above (1) to (7), wherein an average solid-solved Si amount and an average solid-solved Mn amount in a base steel surface layer portion, which is in a region from a plating/base steel interface to a depth of 0.5 μm therefrom, are each 0.5 mass percent or less.

(9) The high-strength galvanized steel sheet having excellent formability, according to one of the above (1) to (7), wherein the high-strength galvanized steel sheet is a high-strength galvanized steel sheet having a plating layer containing 7% to 15% of Fe, and in a base steel surface layer portion, which is in a region from a plating/base steel interface to a depth of 0.5 μm therefrom, an average solid-solved Si amount is 70% to 90% of a Si amount of an average parent material composition, and an average solid-solved Mn amount is 50% to 90% of an Mn amount of the average parent material composition.

(10) A method for manufacturing a high-strength galvanized steel sheet having excellent formability, wherein after a slab having components described in one of the above (1) to (6) is hot-rolled and cold-rolled, when annealing is performed in a continuous galvanizing line having a heating zone of a direct-firing furnace type or a non-oxidizing furnace type, heating is performed in the heating zone at an average heating rate of 10° C./sec or more from 400° C. to a heating-zone outlet-side temperature so that the heating-zone outlet-side temperature is 600° C. or more; then in a reducing zone, heating is performed at an average heating rate of 0.1 to 10° C./sec to a maximum reaching temperature of 750° C. or more and is held for 30 seconds or more; subsequently, cooling is performed from 750° C. to 350° C. or less at an average cooling rate of 10° C./sec or more; then heating is performed to 350° C. to 700° C. and is held for 1 second or more; and subsequently, hot-dip galvanizing is performed, or an alloying treatment after the hot-dip galvanizing is further performed.

Accordingly, since a high-strength galvanized steel sheet which has good manufacturability and high formability or which further has an excellent anti-powdering property can be manufactured at a low cost as compared to that by a conventional technique, the industrial utility value is very high, and in particular, excellent advantages in weight reduction and rust protection of an automobile body can be obtained, so that industrial advantages are significant.

DETAILED DESCRIPTION

In steel having a tensile strength of 780 Mpa or more, under the condition in which the addition of Al is controlled to a level to be used for general deacidification, a high-strength galvanized steel sheet having excellent workability, in which the product of the tensile strength and the total elongation is 15,000 MPa·% or more and the product of the tensile strength and the hole expansion rate is 45,000 MPa·% or more is obtained, and a method for manufacturing the above steel sheet is obtained. To simultaneously achieve weight reduction and high rigidity, the number of automobile body parts having complicated shapes has been increased, and when the product of the tensile strength and the total elongation satisfies 15,000 MPa·% or more and the product of the tensile strength and the hole expansion rate satisfies 45,000 MPa·% or more, by using a high-tensile strength steel sheet, a significantly larger number of parts can be manufactured than that in the past.

We investigated influences of microstructures of various types of steel sheets on the product of the tensile strength and the total elongation and the product of the tensile strength and the hole expansion rate. As a result, the correlation between the distribution of the nano-hardness of the structure in a steel sheet and the product of the tensile strength and the hole expansion rate was observed. That is, we found that when the standard deviation of the nano-hardness of a part located at one fourth of the sheet thickness, which is the part generally represented as the steel sheet structure at which a phase fraction and/or hardness is measured, is 1.50 GPa or less, the product of the tensile strength and the hole expansion rate is high.

The nano-hardness is the hardness measured by applying a load of 1,000 μN using TRIBOSCOPE manufactured by Hysitron Inc. In particular, approximately 50 points, approximately 7 lines each including 7 points disposed with pitches of 5 μm, were measured, and the standard deviation thereof was obtained. (Details are described in the examples.)

As a method for measuring the hardness of a microstructure, the Vickers hardness is famous. However, the minimum value of a loading weight according to the Vickers hardness measurement is 0.5 gf and, even in the case of hard martensite, the indentation size is 1 to 2 μm, so that the hardness measurement of a microscopic phase is impossible. Furthermore, since martensite has a layered structure of packet, block, and lath, and bainite also has a layered structure called a sheaf or a sub-unit, as disclosed in "Proceedings of the International Workshop on the Innovative Structural Materials for Infrastructure in 21st Century," p. 189 (FIG. 4), layers influencing on the hardness measured by the indentation size are different from each other. For example, an evaluation result obtained using an indentation size of 1 μm or less and that obtained using an indentation size of 10 μm or more, which can be measured by a Vickers hardness meter, are different from each other, and the correlation between the mechanical property and the Vickers hardness is not the same as the correlation between the mechanical property and the nano-hardness. Under our measurement conditions, the length of one side of the indentation was 300 to 800 nm, and it was found that, by decreasing the standard deviation of this nano-hardness, the hole expansion rate can be improved.

In addition, it was also found that when martensite and/or retained austenite is reduced while a large amount of Si is added, without using Al, the elongation can be improved while the hole expansion rate is maintained. Although the addition of Si caused degradation in anti-powdering property in the past, also on this point, adhesion sufficient in practical use could be maintained.

Hereinafter, our steels and methods will be described in detail. First, reasons for limiting a steel sheet microstructure and chemical components of steel will be described. The unit of the element content of a chemical component of steel and the unit of that of a plating layer each indicate "mass percent" and is hereinafter simply represented by "%."

Standard Deviation of Nano-Hardness being 1.50 GPa or less:

When the nano-hardness is measured at approximately 50 points in the vicinity of a position located at approximately one fourth of a sheet thickness, if the standard deviation of the nano-hardness is more than 1.50 GPa, the product of the tensile strength and the hole expansion rate cannot satisfy 45,000 MPa·% or more. Hence, it is set to 1.50 GPa or less. It is preferably 1.0 GPa or less. The standard deviation a is obtained from n hardness data x by using equation (1):

$$\sigma = \sqrt{\frac{n\sum x^2 - (\sum x)^2}{n(n-1)}}. \quad (1)$$

C: 0.05% to 0.3%

Since C is an element which stabilizes austenite and which allows hard phases other than ferrite, that is, martensite, bainite, retained austenite, tempered martensite, and tempered bainite, to be easily generated, C is an essential element to improve a TS-elongation balance (the product of the tensile strength and the elongation) by complexing the microstructure as well as to increase the steel strength. When the C amount is less than 0.05%, even when the manufacturing conditions are optimized, it is difficult to ensure the phases other than ferrite, and the product of the tensile strength and the elongation is degraded. On the other hand, when the C amount is more than 0.30%, a welded part and a thermally influenced part are considerably hardened, and mechanical properties of the welded part are degraded. From the points described above, the C amount is set in the range of 0.05% to 0.30%. Preferably, the amount is in the range of 0.08% to 0.15%.

Si: more than 0.60% to 2.0%

Si is an effective element to strengthen steel. In particular, Si has an effect of decreasing the standard deviation of nano-hardness in steel having a complex microstructure. Although details have not been understood, when it is intended to obtain a steel sheet having the same tensile strength, it is estimated that Si does not allow the nano-hardness of a hard phase to easily increase. In addition, although it is an element which generates ferrite, since Si promotes the segregation of C in austenite, it allows hard phases other than ferrite, that is, martensite, bainite, retained austenite, tempered martensite, and tempered bainite, to be easily generated, and by obtaining a complex structure of ferrite and hard phases, the product of the tensile strength and the elongation of high-strength steel is improved. In addition, solid-solved Si in ferrite also has an effect of improving the product of the tensile strength and the total elongation and the hole expansion properties of a steel sheet. The effect described above can be obtained by addition in an amount of more than 0.60%. However, when the Si amount is more than 2.0%, degradation in formability and toughness caused by an increase in solid-solved amount in ferrite occurs, and/or by generation of red scale and the like, degradation in surface properties and that in plating adhesion/anti-powdering property of hot-dip plating occur. Hence, the Si amount is set in the range of more than 0.60% to 2.0%. Preferably, the amount is in the range of 0.80% to 1.5%.

Mn: 0.50% to 3.50%

Mn is an effective element to strengthen steel. In addition, Mn is an element to stabilize austenite and is a necessary element to improve the product of the tensile strength and the elongation as well as to increase the volumes of phases other than ferrite and to ensure the strength. This effect can be obtained by addition of Mn in an amount of 0.50% or more. On the other hand, when Mn in an amount of more than 3.50% is excessively added, by an excessively high hard phase fraction and solid-solution strengthening, the ductility of ferrite is seriously degraded, and the formability is degraded. Hence, the Mn amount is set to 3.50% or less. Preferably, the amount is set in the range of 1.5% to 3.0%.

P: 0.003% to 0.100%

P is an effective element to strengthen steel, and this effect can be obtained by addition of P in an amount of 0.003% or more. However, when P in an amount of more than 0.100% is excessively added, due to grain boundary segregation, embrittlement occurs and, as a result, impact resistance is degraded. Hence, the P amount is set in the range of 0.003% to 0.100%.

S: 0.010% or less

Since S forms an inclusion, such as MnS, and causes degradation in impact resistance and cracking along a metal flow of a welded part, the S amount is preferably decreased as small as possible. From a manufacturing cost point of view, the amount is set to 0.010% or less; however, when the amount is 0.003% or less, since the hole expansion properties are significantly improved, the amount is preferably 0.003% or less.

Al: 0.010% to 0.06%

Al fixes oxygen in steel in process and in a slab and suppresses the generation of defects, such as slab cracking. The above effect is observed by addition in an amount of 0.010% or more. However, when a large amount is added, the risk probability of slab-cracking generation in continuous casting is increased, and manufacturing properties are degraded. In addition, since an alloying cost is increased, the amount is set to 0.06% or less.

N: 0.007% or less

When the total N amount is more than 0.007%, coarse AlN in a steel sheet is increased, and fatigue properties are rapidly degraded. Hence, the amount is set to 0.007% or less.

The above component compositions are used as essential components, and the balance includes iron and inevitable impurities. However, the following component compositions may also be appropriately contained:

At least one selected from the group consisting of Cr: 0.005% to 2.00%, V: 0.005% to 2.00%, Mo: 0.005% to 2.00%, Ni: 0.005% to 2.00%, and Cu: 0.005 to 2.00%.

Cr: 0.005% to 2.00%

Cr suppresses the generation of perlite when cooling is performed from an annealing temperature, allows martensite, bainite, retained austenite, tempered martensite, and tempered bainite to be easily generated, and improves the product of the tensile strength and the elongation. This effect can be obtained by addition in an amount of 0.005% or more. However, when the amount is more than 2.00%, the effect is saturated and, as a result, it causes an increase in cost. Hence, the amount is set in the range of 0.005% to 2.00%.

V: 0.005% to 2.00%

V suppresses the generation of perlite when cooling is performed from the annealing temperature, allows martensite, bainite, retained austenite, tempered martensite, and tempered bainite to be easily generated, and improves the product of the tensile strength and the elongation. This effect can be obtained by addition in an amount of 0.005% or more. However, when the amount is more than 2.00%, the effect is saturated and, as a result, it causes an increase in cost. Hence, the amount is set in the range of 0.005% to 2.00%.

Mo: 0.005% to 2.00%

Mo suppresses the generation of perlite when cooling is performed from the annealing temperature, allows martensite, bainite, retained austenite, tempered martensite, and tempered bainite to be easily generated, and improves the product of the tensile strength and the elongation. This effect can be obtained by addition in an amount of 0.005% or more. However, when the amount is more than 2.00%, the effect is saturated and, as a result, it causes an increase in cost. Hence, the amount is set in the range of 0.005% to 2.00%.

Ni: 0.005% to 2.00%

Ni suppresses the generation of perlite when cooling is performed from the annealing temperature, allows martensite, bainite, retained austenite, tempered martensite, and tempered bainite to be easily generated, and improves the product of the tensile strength and the elongation. This effect can be obtained by addition in an amount of 0.005% or more. However, when the amount is more than 2.0%, the effect is saturated and, as a result, it causes an increase in cost. Hence, the amount is set in the range of 0.005% to 2.00%.

Cu: 0.005% to 2.00%

Cu suppresses the generation of perlite when cooling is performed from the annealing temperature, allows martensite, bainite, retained austenite, tempered martensite, and tempered bainite to be easily generated, and improves the product of the tensile strength and the elongation. This effect can be obtained by addition in an amount of 0.005% or more. However, when the amount is more than 2.00%, the effect is saturated and, as a result, it causes an increase in cost. Hence, the amount is set in the range of 0.005% to 2.00%.

One or two selected from the group consisting of Ti: 0.01% to 0.2% and Nb: 0.01% to 0.1%.

Ti: 0.01% to 0.2%

Ti is effective to strengthen steel and, in addition, it uniformly precipitates carbides and deposits and strengthens a ferrite base. Hence, the standard deviation of nano-hardness can be further decreased, and the product of the tensile strength and the hole expansion rate is improved. Although this effect can be obtained by addition in an amount of 0.01% or more, when the amount is more than 0.2%, the effect is saturated and, as a result, it causes an increase in cost. Hence, the amount is set in the range of 0.01% to 0.2%.

Nb: 0.01% to 0.1%

Nb is effective to strengthen steel, and in addition, it uniformly precipitates carbides and deposits and strengthens a ferrite base. Hence, the standard deviation of nano-hardness can be further decreased, and the product of the tensile strength and the hole expansion rate is improved. Although this effect can be obtained by addition in an amount of 0.01% or more, when the amount is more than 0.1%, the effect is saturated and, as a result, it causes an increase in cost. Hence, the amount is set in the range of 0.01% to 0.1%.

B: 0.0002% to 0.0050%

B has an effect of suppressing the generation of ferrite from austenite grain boundaries and of increasing the strength. This effect can be obtained by addition in an amount of 0.0002% or more. However, when the amount is more than 0.0050%, the effect is saturated and, as a result, it causes an increase in cost. Hence, the amount is set in the range of 0.0002% to 0.0050%.

At least one selected from the group consisting of Ca: 0.001% to 0.005% and REM: 0.001% to 0.005%.

Ca: 0.001% to 0.005%

Ca has a function to contribute to improvement in elongation and hole expansion rate, that is, in formability, by improvement in local ductility. This effect can be obtained by addition in an amount of 0.001% or more and is saturated in an amount of 0.005%. Hence, the amount is set in the range of 0.001% to 0.005%.

REM: 0.001% to 0.005%

REM has a function to contribute to improvement in elongation and hole expansion rate, that is, in formability, by improvement in local ductility. This effect can be obtained by addition in an amount of 0.001% or more and is saturated in an amount of 0.005%. Hence, the amount is set in the range of 0.001% to 0.005%.

Next, the steel sheet microstructure will be described.

Ferrite having an area fraction of 20% or more:

When the area fraction of ferrite is less than 20%, the product of the tensile strength and the elongation is degraded. Hence, the area fraction of ferrite is set to 20% or more and is preferably 50% or more.

The total area fraction of tempered martensite, tempered bainite, and bainite being 10% or more:

When the total area fraction of those phases is less than 10%, it becomes difficult to ensure the strength and, in addition, the product of the tensile strength and the elongation is also degraded. Hence, the total area fraction of those phases is set to 10% or more. However, when those phases are excessively contained, the product of the tensile strength and the elongation is degraded. Hence, the total area fraction of the above structure is preferably 50% or less.

The total area fraction of ferrite, tempered martensite, tempered bainite, and bainite being 90% or more:

When the total area fraction of those phases is less than 90%, the product of the tensile strength and the hole expansion rate is degraded. Hence the total area fraction of those phases is set to 90% or more and is preferably 95% or more.

The total area fraction of retained austenite and martensite being 5% or less:

When the total area fraction of those phases is set to 5% or less, the product of the tensile strength and the hole expansion rate is significantly improved. Preferably, the total area fraction is 3% or less.

A solid-solved Si amount and a solid-solved Mn amount in a base steel surface layer portion, which is in a region from a plating/base steel interface to a depth of 0.5 μm therefrom, will be described.

In a high-strength galvanized steel sheet which is not processed by an alloying treatment after hot-dip galvanizing, the average solid-solved Si amount and the average solid-solved Mn amount in the base steel surface layer portion, which is the region from a plating/base steel interface to a depth of 0.5 μm therefrom, are each 0.5 mass percent or less.

When the Si and Mn amounts in steel are large, since Si and Mn are segregated on the surface at an annealing stage right before hot-dip galvanizing, in a galvanized steel sheet which is not processed by an alloying treatment after hot-dip galvanizing, the anti-powdering property is liable to be degraded. Hence, in a galvanized steel sheet, in view of the anti-powdering property, it is necessary to perform internal oxidation of an easily oxidizable element, which is selectively oxidized at a base steel surface layer in annealing, so as to significantly decrease the absolute solid-solved amount of the easily oxidizable element in a parent material of a surface layer portion. When a region in which the internal oxidation is performed in a manufacturing process is the base steel surface layer portion in the region from a plating/base steel interface to a depth of 0.5 μn therefrom, plating properties can be sufficiently ensured. Hence, the composition control in this region is taken into consideration. When the solid-solved Si amount and the solid-solved Mn amount in a base steel in the region from a plating/base steel interface to a depth of 0.5 μm therefrom are each 0.5 mass percent or less, an anti-powdering property which is sufficient in practical use can be ensured, and the generation of non-plating can be prevented. However, when the solid-solved amount is more than 0.5 mass percent, the non-plating may occur and/or the anti-powdering property may be degraded. Hence, to ensure the anti-powdering property and to prevent the generation of non-plating, the solid-solved Si amount and the solid-solved Mn amount in the base steel surface layer portion in the region from a plating/base steel interface to a depth of 0.5 μm therefrom are each necessarily set to 0.5 mass percent or less.

Before being passed through CGL (continuous galvanizing line), the parent material may be processed in advance by surface modification and internal oxidation. Although a surface modification method is not particularly limited, for example, a hot-rolled steel sheet may be processed by a heat treatment or may be coiled at a relatively high temperature, such as 650 C.° or more, or a cooling rate of a coiled coil may be decreased. As a heat treatment method, for example, a heat treatment method in which a hot-rolled coil is processed at 650 C.° in a non-reducing atmosphere, such as an $N_2$ atmosphere, may be mentioned.

In addition, the surface segregation of Si, Mn, and the like right before hot-dip galvanizing may be suppressed such that a heating zone of CGL having a DFF (direct-firing furnace) or an NOF (non-oxidizing furnace) type is used, the base steel surface layer is processed by an oxidation treatment in the heating zone of CGL and is then processed by internal oxidation in the manner as described above using oxygen supplied from iron scale when a reducing treatment is performed so as to decrease the solid-solved element amount of the easily oxidizable element in a parent material surface layer. As described later, as for the solid-solved Si amount and the solid-solved Mn amount in the surface layer portion, for example, when a steel sheet temperature at a heating-zone outlet side is increased when a reducing treatment is performed in a reducing zone following an oxidation treatment, Si, Mn, and the like are processed by internal oxidation, so that the solid-solved Si amount and the solid-solved Mn amount in the base steel surface layer portion can be decreased. Hence, by appropriate control of the temperature at the heating-zone outlet side, the solid-solved Si amount and the solid-solved Mn amount in the base steel surface layer portion can be controlled.

The presence of oxides can be determined, for example, by a method in which after a plated steel sheet is buried in a resin and is then polished to expose a steel sheet cross-section, the coexistence of oxygen and Si, Mn, or the like, which is an easily oxidizable element, is composition-analyzed using EPMA, or by composition analysis of an extraction replica of a cross-section or a thin-film sample processed by FIB using TEM.

The solid-solved Si and Mn amounts in the base steel can be determined by composition analysis of a cross-section of a sample prepared in the manner as described above at a place at which no oxides are precipitated. In addition, to prevent the error caused by characteristic x-rays from oxides present in the vicinity of an analyzed location, which is due to the spread of electron beams, for the measurement of the solid-solved amount, a method is preferable in which TEM-EDS composition analysis of a thin-film sample processed by FIB is performed at a magnification of 20,000 times or more. In this method, since the sample is a thin film, the spread of electron beams is suppressed, the error caused by characteristic x-rays from oxides present in the vicinity of an analyzed location is suppressed and, hence, precise measurement of the solid-solved element amount of the base steel itself can be performed.

As for a galvanized steel sheet in which a plating layer is not processed by an alloying treatment, a surface layer structure right below the plating layer maintains, to a much greater degree, the conditions right after annealing performed right before plating, and when the solid-solved Si amount and the solid-solved Mn amount are decreased beforehand, the solid-solved Si amount and the solid-solved Mn amount in the base steel surface layer portion in the region from a plating/base steel interface to a depth of 0.5 μm therefrom can be controlled to 0.5 mass percent or less.

In a galvanized steel sheet in which a plating layer is processed by an alloying treatment, an Fe percent in the plating layer is 7% to 15%, and as for the average solid-solved Si amount and the average solid-solved Mn amount in the base steel surface layer portion in the region from a plating/base steel interface to a depth of 0.5 μm therefrom, the average solid-solved Si amount is 70% to 90% of a Si amount of an average parent material composition, and the average solid-solved Mn amount is 50% to 90% of an Mn amount of the average parent material composition.

When the Fe percent in the plating layer is less than 7%, appearance defects, such as burn irregularities, occur, and when the Fe percent is more than 15%, plating-layer peeling frequently occurs in a bending step. Hence, the Fe percent in the plating layer must be in the range of 7% to 15%. The Fe percent is more preferably in the range of 8% to 13%.

In an alloyed galvanized steel sheet, the surface layer structure right below the plating layer is slightly different from the conditions right after annealing performed right before plating since the base steel surface layer is dissolved in the plating layer by the alloying treatment, that is, the solid-solved Si amount and the solid-solved Mn amount are increased as compared to those of a galvanized steel sheet in which a plating layer is not processed by an alloying treatment. The average solid-solved Si amount and the solid-solved Mn amount in the base steel surface layer portion in the region from a plating/base steel interface to a depth of 0.5 μm therefrom are required to be 70% to 90% of the Si amount and 50% to 90% of the Mn amount, respectively, of the average parent material composition to ensure the anti-powdering property and alloying uniformity.

When Si and Mn are solid-solved in the parent material to a certain extent, an effect of improving the adhesion at an interface after the formation of a Fe—Zn alloy can be obtained. The reason for this is believed that Si, Mn and the like solid-solved in the parent material appropriately cause an uneven Fe—Zn alloying reaction to induce an anchor effect at the interface. When the average solid-solved Si amount in the base steel surface layer portion in the region from a plating/base steel interface to a depth of 0.5 μm therefrom is 70% or more of the Si amount of the average parent material composition and when the average solid-solved Mn amount in the base steel surface layer portion in the region from a plating/base steel interface to a depth of 0.5 μm therefrom is 50% or more of the Mn amount of the average parent material composition, the above effect can be sufficiently obtained. When the average solid-solved Si amount is less than 70% of the Si amount of the average parent material composition and when the average solid-solved Mn amount is less than 50% of the Mn amount of the average parent material composition, the above effect cannot be sufficiently obtained, the anchor effect is degraded, and the anti-powdering property is degraded. In the region from a plating/base steel interface to a depth of 0.5 μm therefrom, when the average solid-solved Si amount is more than 90% of the Si amount of the average parent material composition, and when the average solid-solved Mn amount is more than 90% of the Mn amount of the average parent material composition, the surface segregation of Si and Mn is increased in annealing, non-plating occurs and, as a result, the anti-powering property is degraded.

In addition, although a solid-solved P amount and a solid-solved Al amount in the base steel surface layer portion in the region from a plating/base steel interface to a depth of 0.5 μm therefrom are not particularly limited, they are preferably less than 50% of a P amount and an Al amount, respectively, of the average parent material composition. However, when the P and Al contents are small, since their presence is difficult to confirm by analysis, the upper limits of P and Al are not particularly limited.

Galvanized amount per one surface being 20 to 150 g/m$^2$:

When the galvanized amount is less than 20 g/m$^2$, it is difficult to ensure the corrosion resistance. In addition, when the galvanized amount is more than 150 g/m$^2$, cost is increased. Hence, the galvanized amount per one surface is set in the range of 20 to 150 g/m$^2$. In addition, in the case of alloyed hot-dip galvanizing, when the iron content (Fe percent (mass percent)) in the plating layer is less than 7%, alloyed irregularities seriously arise, and flaking occurs in a bending step; hence, it is not preferable. In addition, in the case in which the Fe percent is more than 15%, a hard Γ phase is formed at the plating/base steel interface. Hence, it is not preferable. Accordingly, in the case of the alloyed hot-dip galvanizing, the Fe percent is preferably in the range of 7% to 15%.

Next, a manufacturing method will be described.

A steel slab having the component composition described above is formed through melting, followed by performing hot rolling and cold rolling, so that a cold-rolled steel sheet is manufactured. The slab formation may be performed in accordance with a conventional method using ingot making, a continuous cast slab, or a thin slab caster. Hot rolling may be performed by reheating after cooling or may be performed immediately after casting. Although a finish rolling temperature is preferably set to $Ar_3$ or more, it is not particularly limited. Although cold rolling may be performed at a cold rolling rate of approximately 30 to 60%, it is not particularly limited.

Next, after the cold-rolled steel sheet is annealed in a continuous galvanizing line having a heating zone of a direct-firing furnace or a non-oxidizing furnace type, hot-dip galvanizing is performed, or an alloying treatment is further performed following the hot-dip galvanizing.

An outlet-side temperature of the heating zone is set to 600 C.° or more, and an average heating rate in the furnace of the heating zone is set to 10 C.°/sec or more from 400 C.° to the heating-zone outlet-side temperature.

In a continuous galvanizing process, to activate the surface at a low cost and to ensure the anti-powdering property of a steel sheet containing a large amount of Si and Mn, manufacturing is preferably performed in CGL (continuous galvanizing line) having a heating zone of a DFF (direct-firing furnace) or a NOF (non-oxidizing furnace) type.

In particular, after an oxidation treatment is performed on the base steel surface layer in the heating zone in the CGL furnace, the base steel surface layer is processed by internal oxidation as described above by oxygen supplied from iron scale when a reducing treatment is performed, so that solid-solved element amounts of easily oxidizable elements in the parent material are decreased; as a result, the surface segregation of Si, Mn, and the like on the steel sheet surface right before hot-dip galvanizing is suppressed. For this purpose, the steel sheet has to be heated so that the steel sheet temperature at the heating-zone outlet side is 600° or more. When the heating-zone outlet-side temperature is less than 600°, an oxidized amount of the steel sheet is small due to a low temperature, and the internal oxidation of the base steel surface layer becomes insufficient when the reducing treatment is performed, so that the solid-solved Si amount and the solid-solved Mn amount in the base steel surface layer right below the plating layer cannot be sufficiently decreased.

In addition, when the average heating rate from 400° to the heating-zone outlet-side temperature in the furnace of the heating zone is less than 10°/sec, tight oxide scale is generated and is not easily reduced and, hence, the average heating rate must be set to 10°/sec or more. Since oxidation hardly occurs at a temperature of less than 400°, the heating rate at less than 400° is not particularly limited. By rapid heating in the heating zone as described above, in addition to an improvement in plating properties, since the steel sheet structure is uniformly and finely formed, the variation in nanohardness is decreased, and the hole expansion properties are improved.

The dew point of the heating zone is preferably 0° C. or more, and the $O_2$ concentration is preferably 0.1% or more.

Next, in the reducing zone, heating is performed to a maximum reaching temperature of 750° or more at an average heating rate of 0.1 to 10° C./sec from a reducing-zone inlet side to the maximum reaching temperature and is held for 30 seconds or more.

Heating from the reducing-zone inlet side to, the maximum reaching temperature being performed at an average heating rate of 0.1 to 10° C./sec:

When the average heating rate from the reducing-zone inlet side to the maximum reaching temperature is less than 0.1° C./sec, since a sheet passing speed must be decreased, the productivity is degraded. In addition, when the average heating rate is 10° C./sec or more, since, in the reducing zone, oxygen in base steel scale reacts with hydrogen in the reducing zone to form $H_2O$, Fe-based oxide scale of the base steel surface layer is consumed by a reducing reaction, and the oxygen amount, which is diffused from the parent material surface layer into the base steel to perform internal oxidation of Si, Mn, and the like, is decreased. As a result, large solid-solved Si and Mn amounts are present in the parent material surface portion, and since those elements are selectively oxidized at a steel sheet surface right before hot-dip galvanizing, the surface segregation of Si, Mn, and the like is facilitated.

Since the reducing zone performs a reducing treatment of the surface, $H_2$ at a concentration of 1% to 100% is preferably contained.

Heating performed to a maximum reaching temperature of 750° C. or more and held for 30 seconds or more:

When the maximum reaching temperature is less than 750° C., or when the holding time is less than 30 seconds, the product of the tensile strength and the elongation is not improved. The reason for this is believed that strain generated after cold rolling is not sufficiently reduced. The upper limit of the heating temperature and the upper limit of the holding time are not particularly limited. However, since the effect is saturated by heating to 950° C. or more or holding for 600 seconds or more and, further, since the cost is increased thereby, the heating temperature and the holding time are preferably less than 950° C. and less than 600 seconds, respectively.

Cooling performed from 750° C. to 350° C. or less at an average cooling rate of 10° C./sec or more:

A steel sheet heated in the heating zone is cooled from 750° C. to 350° C. or less at an average cooling rate of 10° C./sec or more. When the average cooling rate is less than 10° C./sec, since perlite is generated in the steel sheet, the total area of ferrite, tempered martensite, bainite, and tempered bainite cannot be 90% or more and, hence, the product of the tensile strength and the elongation and the product of the tensile strength and the hole expansion rate cannot be improved. As the cooling rate is increased, a harder low-temperature transformation phase is likely to be generated. Since tempered martensite is preferably generated as much as possible, cooling is preferably performed at an average cooling rate of 30° C./sec or more, and when the average cooling rate is 100° C./sec or more, it is more preferable. On the other hand, when it is more than 500° C./sec, the shape of a steel sheet is degraded, and it becomes difficult to perform appropriate control of an adhesion amount of hot-dip plating and to ensure the uniformity along an entire sheet length. Hence, the average cooling rate is preferably 500° C./sec or less.

A reaching temperature condition by cooling is one of the most important factors. When the reaching temperature by cooling is more than 350° C., martensite and/or retained austenite in an amount of more than 10% is generated in a final structure after hot-dip plating and, hence, the product of the tensile strength and the hole expansion rate is seriously degraded. Hence, the reaching temperature by cooling is set to 350° C. or less. For the above property, the reaching temperature by cooling is preferably 200° C. or less. However, the effect is saturated at room temperature or less. The time from the end of cooling to the start of re-heating is not particularly limited since it has no influence on materials. Although the time from the end of cooling to the start of re-heating is preferably decreased in terms of cost reduction, after the end of cooling, the steel sheet may be coiled once and be again passed through a plating line for heating. In this case, to remove scales and the like on the steel sheet surface, pickling and cleaning may be performed before plating.

Hot-dip galvanizing being performed after heating performed to 350° C. to 700° C. and then held for 1 second or more:

After cooling is rapidly performed to 350° C. or less, heating is performed. In the heating, when heating is performed to less than 350° C. or more than 700° C., the product of the tensile strength and the hole expansion rate is seriously degraded. The reason for this is believed that even after hot-dip plating, hard phases, such as retained austenite and martensite, are generated. From a cost point of view, the heating is more preferably performed to less than 500° C. In addition, the heating is preferably performed from the temperature before heating to a higher temperature, and an increase in temperature is preferably 200° C. or more and is more preferably 250° C. or more. When the holding time after the heating is less than 1 second, the product of the tensile strength and the hole expansion rate is not improved. Hence, the holding time is set to 1 second or more. In addition, although the holding time is set to 600 seconds and more, the effect is saturated and, hence, in consideration of the above property, the holding time is preferably set in the range of 10 to 300 seconds.

Hot-dip galvanizing can be performed by immersing a steel sheet into a general plating bath. In addition, after the hot-dip galvanizing, when an alloying treatment of the plating film is performed, after the immersion into the plating bath, heating may be performed to 490 to 550° C. and may be held for 1 to 30 seconds.

EXAMPLES

Hereinafter, our steels and methods will be described in detail with reference to examples. However, the following examples do not limit this disclosure, and design changes without departing from the spirit and scope of the disclosure are also included in the technical range of our steels and methods.

Slabs formed by vacuum melting of steel (A to T) having chemical components shown in Table 1 were each hot-rolled at a finish rolling temperature of 900° C. to form a hot-rolled steel sheet and were each further cold-rolled at a cold rolling rate of 50% following pickling, so that a cold-rolled steel sheet having a thickness of 1.6 mm was obtained. After this cold-rolled steel sheet was annealed under conditions shown in Table 2, hot-dip galvanizing was performed at 460° C., and an alloying treatment was then performed by heating at 480 to 580° C. for 10 seconds followed by performing cooling at a rate of 10° C./sec. Some galvanized steel sheets (steel J and M), which were not processed by the alloying treatment, were also manufactured. The plating adhesion amounts were each set in the range of 35 to 45 g/m$^2$.

The anti-powdering property of the plated steel sheets thus obtained was evaluated. For a plated steel sheet (GA) processed by the alloying treatment, after a bent portion which was bent by 90° was processed by Cello-Tape (registered trade name) peeling, the Zn count number of the peeled amount per unit length was measured by using fluorescent x-rays, and in accordance with the following standard, ranks 1 and 2 were evaluated as excellent (○, Δ), and rank 3 or more was evaluated as defective.

| Zn Count Number by Fluorescent X-Rays | Rank |
|---|---|
| 0 to less than 500 | 1 (excellent) |
| 500 to less than 1,000 | 2 |
| 1,000 to less than 2,000 | 3 |
| 2,000 to less than 3,000 | 4 |
| more than 3,000 | 5 (inferior) |

As for a steel sheet (GI) which was not alloyed, in an impact test, plate peeling was required to be suppressed. Accordingly, a ball impact test was performed, a processed portion was treated by Cello-Tape (registered trade name) peeling, and the occurrence of plating layer peeling was determined by visual inspection.

○ No peeling of plating layer x Peeling of plating layer

The following investigation was performed on the galvanized steel sheets manufactured as described above. The investigation results are shown in Table 3.

After a cross-sectional microstructure of the steel sheet was exposed using a nital solution at a concentration of 3%, a sheet thickness ¼ position (a position corresponding to a depth of one fourth of the thickness of the sheet from the surface thereof) was observed by a scanning electron microscope (SEM) at a magnification of 1,000 times, and from a microstructure photograph thus obtained, the area rate of a ferrite phase was quantified (the structure may be quantified by using an image processing software such as Photo Shop by Adobe Inc). The total area fraction of martensite and retained austenite was obtained such that SEM photographs were taken at an appropriate magnification in the range of 1,000 to 3,000 times in accordance with the degree of fineness of the structure, and among parts other than ferrite, a part where no carbides were precipitated, which was determined by visual inspection, was quantified. Tempered martensite, tempered bainite, and bainite were regarded as a part other than ferrite, martensite, retained austenite, and perlite, so that the total area fraction of the tempered martensite, tempered bainite, and bainite was quantified. In addition, the quantification of the structure may be performed using the above image processing software.

As for the tensile properties, a method was performed in accordance with JIS Z 2241 using a JIS No. 5 test piece. TS (tensile strength) and T.El (total elongation) were measured, and the value of strength-elongation balance represented by the product of the strength and the total elongation (TS×T.El) was obtained.

A hole expansion test was performed in accordance with JFST 1001 of the Japan Iron and Steel Federation Standard and, under each sample condition, the average value was obtained from three test results.

As for the nano-hardness, measurement was performed at a sheet thickness ¼ position (a position corresponding to a depth of one fourth of the thickness of the sheet from the surface thereof), and by using TRIBOSCOPE manufactured by Hysitron Inc., 49 to 56 points, 7 points by 7 to 8 points at intervals of 3 to 5 μm, were measured. The indentation was formed to have a triangle shape having a one-side length of 300 to 800 nm by primarily applying a load of 1,000 μN, and when the one-side length of some indentation was more than 800 nm, the load was changed to 500 μN. The measurement was performed at positions at which crystal grain boundaries and different phase boundaries were not present. The standard deviation a was obtained from n hardness data x using the above equation (1).

To measure the solid-solved Si and Mn amounts of the surface layer, a point analysis of Si and Mn was performed by TEM-EDS on a thin-film cross-sectional sample processed by FIB in a region from just above a plating/parent material interface to a depth of 0.5 μm to the base steel side, in which no precipitation was present to avoid disturbance. Measurement was performed at arbitrary 10 points, and the average value obtained therefrom was regarded as an evaluation value. For the steel sheet (GA) processed by an alloying treatment, the chemical components (Si, Mn) shown in Table 1 were used as the average parent material composition, and the ratio of the solid-solved amount (average value) obtained as described above to the chemical component value of Table 1 was obtained and is shown in Table 3.

TABLE 1

(MASS PERCENT %)

| STEEL TYPE | C | Si | Mn | P | S | Al | N | Cr | V | Mo | Ni | Cu | Ti | Nb | B | Ca | Y | |
|---|---|---|---|---|---|---|---|---|---|---|---|---|---|---|---|---|---|---|
| A | 0.06 | 0.85 | 2.52 | 0.020 | 0.003 | 0.035 | 0.003 | | | | | | | | | | | PRESENT INVENTION STEEL |
| B | 0.08 | 1.24 | 2.40 | 0.015 | 0.002 | 0.037 | 0.002 | | | | | | | | | | | PRESENT INVENTION STEEL |
| C | 0.12 | 0.88 | 2.79 | 0.017 | 0.004 | 0.021 | 0.005 | | | | | | | | | | | PRESENT INVENTION STEEL |
| D | 0.14 | 1.02 | 3.21 | 0.019 | 0.002 | 0.041 | 0.004 | | | | | | | | | | | PRESENT INVENTION STEEL |
| E | 0.19 | 1.14 | 1.83 | 0.025 | 0.003 | 0.036 | 0.004 | | | | | | | | | | | PRESENT INVENTION STEEL |
| F | 0.25 | 0.92 | 3.30 | 0.013 | 0.005 | 0.028 | 0.005 | | | | | | | | | | | PRESENT INVENTION STEEL |
| G | 0.13 | 1.32 | 2.02 | 0.008 | 0.006 | 0.031 | 0.003 | 0.60 | | | | | | | | | | PRESENT INVENTION STEEL |
| H | 0.16 | 0.62 | 2.75 | 0.014 | 0.002 | 0.033 | 0.004 | | 0.2 | | | | | | | | | PRESENT INVENTION STEEL |
| I | 0.08 | 0.94 | 2.24 | 0.007 | 0.003 | 0.025 | 0.002 | | | 0.3 | | | | | | | | PRESENT INVENTION STEEL |
| J | 0.09 | 1.13 | 2.25 | 0.007 | 0.002 | 0.033 | 0.001 | | | | 0.8 | | | | | | | PRESENT INVENTION STEEL |
| K | 0.10 | 1.45 | 2.57 | 0.014 | 0.001 | 0.042 | 0.003 | | | | | 0.3 | | | | | | PRESENT INVENTION STEEL |
| L | 0.10 | 0.76 | 1.92 | 0.021 | 0.005 | 0.015 | 0.004 | | | | | | 0.05 | | | | | PRESENT INVENTION STEEL |
| M | 0.15 | 1.22 | 2.92 | 0.006 | 0.004 | 0.026 | 0.002 | | | | | | | 0.04 | | | | PRESENT INVENTION STEEL |
| N | 0.09 | 1.95 | 2.07 | 0.012 | 0.003 | 0.028 | 0.005 | | | | | | | | 0.001 | | | PRESENT INVENTION STEEL |
| O | 0.08 | 0.96 | 2.16 | 0.010 | 0.002 | 0.046 | 0.001 | 0.30 | | | | | | | | 0.003 | | PRESENT INVENTION STEEL |
| P | 0.07 | 1.34 | 2.91 | 0.019 | 0.004 | 0.036 | 0.003 | | | 0.2 | | | | | | | 0.002 | PRESENT INVENTION STEEL |
| Q | 0.04 | 1.42 | 3.22 | 0.013 | 0.002 | 0.022 | 0.002 | | | | | | | | | | | COMPARATIVE STEEL |
| R | 0.12 | 0.52 | 2.63 | 0.017 | 0.006 | 0.041 | 0.004 | | | | | | | | | | | COMPARATIVE STEEL |
| S | 0.08 | 0.82 | 3.61 | 0.022 | 0.001 | 0.036 | 0.002 | | | | | | | | | | | COMPARATIVE STEEL |
| T | 0.15 | 1.24 | 0.44 | 0.007 | 0.003 | 0.029 | 0.002 | | | | | | | | | | | COMPARATIVE STEEL |

UNDER LINE PORTION: CONDITION OUT OF THE PRESENT INVENTION

TABLE 2

| No. | STEEL TYPE | HEATING-ZONE OUTLET-SIDE TEMP. (° C.) | HEATING RATE OF HEATING ZONE (° C./s) | HEATING RATE OF REDUCING ZONE (° C./s) | MAXIMUM REACHING TEMP. (° C.) | HOLDING TIME (s) | COOLING RATE (° C./s) | REACHING TEMP. AFTER COOLING (° C.) |
|---|---|---|---|---|---|---|---|---|
| 1 | A | 650 | 15 | 2.0 | 820 | 60 | 200 | 300 |
| 1-1 | A | 500 | 15 | 2.0 | 820 | 60 | 200 | 300 |
| 1-2 | A | 818 | 15 | 2.0 | 820 | 60 | 200 | 300 |
| 2 | A | 650 | 15 | 2.0 | 720 | 60 | 200 | 300 |
| 3 | B | 700 | 20 | 1.0 | 800 | 90 | 50 | 60 |
| 4 | B | 700 | 20 | 1.0 | 800 | 20 | 50 | 60 |
| 5 | C | 750 | 15 | 0.8 | 880 | 90 | 30 | 200 |
| 6 | C | 750 | 15 | 0.8 | 880 | 90 | 5 | 200 |
| 7 | D | 630 | 20 | 0.6 | 780 | 150 | 15 | 20 |
| 8 | D | 630 | 20 | 0.6 | 780 | 150 | 15 | 400 |
| 9 | E | 620 | 10 | 1.0 | 850 | 75 | 80 | 100 |
| 10 | E | 620 | 10 | 1.0 | 850 | 75 | 80 | 100 |
| 11 | E | 620 | 10 | 1.0 | 850 | 75 | 80 | 100 |
| 12 | F | 680 | 20 | 4.0 | 800 | 240 | 90 | 150 |
| 13 | F | 680 | 20 | 4.0 | 800 | 240 | 90 | 150 |
| 14 | G | 700 | 25 | 0.8 | 850 | 60 | 100 | 100 |
| 15 | G | 700 | 25 | 0.8 | 850 | 60 | 100 | 100 |
| 16 | H | 650 | 30 | 1.5 | 840 | 120 | 90 | 50 |
| 17 | I | 750 | 20 | 0.5 | 830 | 75 | 150 | 20 |
| 18 | I | 750 | 20 | 0.5 | 830 | 75 | 150 | 350 |
| 19 | J | 720 | 15 | 2.0 | 800 | 45 | 1000 | 20 |
| 20 | K | 800 | 30 | 0.7 | 750 | 200 | 100 | 150 |
| 21 | L | 700 | 15 | 5.0 | 780 | 120 | 200 | 300 |
| 22 | M | 750 | 15 | 1.5 | 840 | 90 | 200 | 100 |
| 23 | N | 680 | 20 | 1.5 | 820 | 60 | 50 | 250 |
| 24 | O | 770 | 12 | 2.5 | 800 | 45 | 150 | 100 |
| 25 | P | 600 | 40 | 0.2 | 860 | 30 | 30 | 200 |
| 26 | Q | 620 | 20 | 1.0 | 780 | 60 | 30 | 200 |
| 27 | R | 650 | 20 | 1.0 | 820 | 90 | 30 | 50 |
| 28 | S | 700 | 20 | 1.0 | 820 | 75 | 200 | 20 |
| 29 | T | 750 | 20 | 1.0 | 840 | 90 | 30 | 100 |

| No. | RE-HEATING TEMP. (° C.) | HOLDING TIME AFTER RE-HEATING (s) | RE-HEATING TEMP. − REACHING TEMP. AFTER COOLING (° C.) | ALLOYING TEMP. (° C.) | PLATING ALLOYING TREATMENT | |
|---|---|---|---|---|---|---|
| 1 | 500 | 30 | 200 | 520 | YES | PRESENT INVENTION EX. |
| 1-1 | 500 | 30 | 200 | 480 | YES | COMP. EX. |
| 1-2 | 500 | 30 | 200 | 580 | YES | COMP. EX. |
| 2 | 500 | 30 | 200 | 520 | YES | COMP. EX. |
| 3 | 400 | 60 | 340 | 520 | YES | PRESENT INVENTION EX. |
| 4 | 400 | 60 | 340 | 520 | YES | COMP. EX. |
| 5 | 450 | 45 | 250 | 520 | YES | PRESENT INVENTION EX. |
| 6 | 450 | 45 | 250 | 520 | YES | COMP. EX. |
| 7 | 450 | 60 | 430 | 520 | YES | PRESENT INVENTION EX. |
| 8 | 450 | 60 | 50 | 520 | YES | COMP. EX. |
| 9 | 400 | 30 | 300 | 520 | YES | PRESENT INVENTION EX. |
| 10 | 300 | 30 | 200 | 520 | YES | COMP. EX. |
| 11 | 720 | 30 | 620 | 520 | YES | COMP. EX. |
| 12 | 400 | 240 | 250 | 520 | YES | PRESENT INVENTION EX. |
| 13 | 400 | 0 | 250 | 520 | YES | COMP. EX. |
| 14 | 500 | 30 | 400 | 520 | YES | PRESENT INVENTION EX. |
| 15 | 500 | 2 | 400 | 520 | YES | PRESENT INVENTION EX. |
| 16 | 400 | 30 | 350 | 520 | YES | PRESENT INVENTION EX. |
| 17 | 500 | 45 | 480 | 520 | YES | PRESENT INVENTION EX. |
| 18 | 500 | 45 | 150 | 520 | YES | PRESENT INVENTION EX. |
| 19 | 400 | 20 | 380 | — | NO | PRESENT INVENTION EX. |
| 20 | 550 | 10 | 400 | 520 | YES | PRESENT |

TABLE 2-continued

| | | | | | | |
|---|---|---|---|---|---|---|
| 21 | 400 | 60 | 100 | 520 | YES | INVENTION EX. PRESENT |
| 22 | 400 | 20 | 300 | — | NO | INVENTION EX. PRESENT |
| 23 | 450 | 90 | 200 | 520 | YES | INVENTION EX. PRESENT |
| 24 | 450 | 150 | 350 | 520 | YES | INVENTION EX. PRESENT |
| 25 | 450 | 30 | 250 | 520 | YES | INVENTION EX. PRESENT |
| 26 | 350 | 60 | 150 | 520 | YES | INVENTION EX. COMP. EX. |
| 27 | 400 | 30 | 350 | 520 | YES | COMP. EX. |
| 28 | 400 | 120 | 380 | 520 | YES | COMP. EX. |
| 29 | 400 | 120 | 300 | 520 | YES | COMP. EX. |

UNDER LINE PORTION: CONDITION OUT OF THE PRESENT INVENTION

* TEMP.: TEMPERATURE/COMP.: COMPARATIVE/Ex.: EXAMPLE

TABLE 3

| No. | STEEL TYPE | Si | Mn | FERRITE AMOUNT (%) | TEMPERED MARTENSITE + TEMPERED BAINITE + BAINITE (%) | AMOUNT OF MARTENSITE + RETAINED AUSTENITE (%) | FERRITE + TEMPERED MARTENSITE + TEMPERED BAINITE + BAINITE (%) | STANDARD DEVIATION OF NANOHARDNESS (Gpa) | TS (Mpa) | TOTAL ELONGATION (%) | TS × ELONGATION (Mpa · %) | HOLE EXPANSION RATE (%) |
|---|---|---|---|---|---|---|---|---|---|---|---|---|
| 1 | A | 0.85 | 2.52 | 57 | 40 | 3 | 97 | 1.42 | 824 | 20.0 | 16480 | 62.0 |
| 1-1 | A | 0.85 | 2.52 | 57 | 38 | 5 | 87 | 1.43 | 830 | 18.0 | 14940 | 50.0 |
| 1-2 | A | 0.85 | 2.52 | 57 | 39 | 5 | 86 | 1.44 | 826 | 17.0 | 14042 | 51.0 |
| 2 | A | 0.85 | 2.52 | 92 | 7 | 1 | 99 | 1.61 | 761 | 17.3 | 13165 | 55.2 |
| 3 | B | 1.24 | 2.40 | 72 | 26 | 2 | 98 | 1.28 | 816 | 22.5 | 18360 | 72.8 |
| 4 | B | 1.24 | 2.40 | 88 | 8 | 4 | 96 | 1.52 | 751 | 18.4 | 13818 | 57.1 |
| 5 | C | 0.68 | 2.79 | 63 | 34 | 3 | 97 | 1.35 | 1017 | 15.3 | 15560 | 55.3 |
| 6 | C | 0.88 | 2.79 | 65 | 19 | 3 | 84 | 2.20 | 895 | 16.5 | 14768 | 43.5 |
| 7 | D | 1.02 | 3.21 | 72 | 27 | 1 | 99 | 1.36 | 1027 | 15.7 | 16124 | 52.4 |
| 8 | D | 1.02 | 3.21 | 70 | 17 | 13 | 87 | 2.21 | 1052 | 15.2 | 15990 | 32.1 |
| 9 | E | 1.14 | 1.83 | 54 | 39 | 7 | 93 | 1.42 | 1225 | 12.6 | 15435 | 44.5 |
| 10 | E | 1.14 | 1.83 | 51 | 28 | 21 | 79 | 2.50 | 1325 | 11.4 | 15105 | 21.1 |
| 11 | E | 1.14 | 1.83 | 47 | 37 | 16 | 84 | 2.41 | 1287 | 11.9 | 15315 | 22.5 |
| 12 | F | 0.92 | 3.30 | 37 | 57 | 6 | 94 | 1.46 | 1208 | 12.5 | 15100 | 44.3 |
| 13 | F | 0.92 | 3.30 | 39 | 40 | 21 | 79 | 4.25 | 1383 | 11.5 | 15905 | 10.2 |
| 14 | G | 1.32 | 2.02 | 72 | 26 | 2 | 98 | 0.72 | 986 | 16.8 | 16565 | 63.4 |
| 15 | G | 1.32 | 2.02 | 70 | 21 | 9 | 91 | 1.42 | 1054 | 15.1 | 15915 | 48.6 |
| 16 | H | 0.62 | 2.75 | 65 | 31 | 4 | 96 | 1.28 | 1028 | 14.8 | 15214 | 49.2 |
| 17 | I | 0.94 | 2.24 | 61 | 39 | 0 | 100 | 0.84 | 995 | 16.2 | 16119 | 63.1 |
| 18 | I | 0.94 | 2.24 | 65 | 28 | 7 | 93 | 1.36 | 1047 | 15.3 | 16019 | 44.7 |
| 19 | J | 1.13 | 2.25 | 71 | 28 | 1 | 99 | 0.65 | 1036 | 15.7 | 16265 | 65.3 |
| 20 | K | 1.45 | 2.57 | 83 | 16 | 1 | 99 | 0.72 | 864 | 20.5 | 17712 | 72.8 |
| 21 | L | 0.76 | 1.92 | 76 | 18 | 6 | 94 | 1.22 | 841 | 18.9 | 15895 | 60.1 |
| 22 | M | 1.22 | 2.92 | 52 | 46 | 2 | 98 | 1.05 | 1235 | 12.3 | 15191 | 48.3 |
| 23 | N | 1.95 | 2.07 | 56 | 36 | 8 | 92 | 1.26 | 1001 | 17.6 | 17618 | 52.1 |
| 24 | O | 0.96 | 2.16 | 69 | 27 | 4 | 96 | 1.14 | 824 | 21.3 | 17551 | 71.6 |
| 25 | P | 1.34 | 2.91 | 68 | 25 | 7 | 93 | 1.43 | 982 | 16.1 | 15810 | 46.5 |
| 26 | Q | 1.42 | 3.22 | 87 | 9 | 3 | 96 | 1.55 | 601 | 23.5 | 14124 | 70.4 |
| 27 | R | 0.52 | 2.63 | 72 | 26 | 2 | 98 | 1.86 | 820 | 17.4 | 14268 | 48.7 |
| 28 | S | 0.82 | 3.61 | 67 | 30 | 3 | 97 | 2.01 | 1046 | 13.2 | 13807 | 35.4 |
| 29 | T | 1.24 | 0.44 | 75 | 14 | 2 | 89 | 1.96 | 492 | 29.7 | 14612 | 72.5 |

| No. | TS × HOLE EXPANSION RATE (Mpa · %) | Fe % | SURFACE-LAYER SOLID-SOLVED Si AMOUNT (GA) (%) | SURFACE-LAYER SOLID-SOLVED Mn AMOUNT (GA) (%) | RATIO OF SURFACE-LAYER SOLID-SOLVED Si AMOUNT (GA) | RATIO OF SURFACE-LAYER SOLID-SOLVED Mn AMOUNT (GA) | SURFACE-LAYER SOLID-SOLVED Si AMOUNT (GI) (%) | SURFACE-LAYER SOLID-SOLVED Mn AMOUNT (GI) (%) | ANTI-POWDERING PROPERTY | |
|---|---|---|---|---|---|---|---|---|---|---|
| 1 | 51088 | 10 | 0.65 | 1.50 | 0.76 | 0.60 | — | — | ○ | PRESENT INVENTION EX. |

TABLE 3-continued

| | | | | | | | | | | |
|---|---|---|---|---|---|---|---|---|---|---|
| 1-1 | 41500 | 6 | 0.81 | 2.20 | 0.95 | 0.87 | — | — | x | COMP. EX. OF CLAIM 10 |
| 1-2 | 42126 | 16 | 0.30 | 0.60 | 0.35 | 0.24 | — | — | x | COMP. EX. OF CLAIM 10 |
| 2 | 42007 | 11 | 0.65 | 1.50 | 0.76 | 0.60 | — | — | ○ | COMP. EX. |
| 3 | 59405 | 9 | 1.00 | 1.30 | 0.81 | 0.54 | — | — | ○ | PRESENT INVENTION EX. |
| 4 | 42882 | 10 | 1.00 | 1.30 | 0.81 | 0.54 | — | — | ○ | COMP. EX. |
| 5 | 56240 | 12 | 0.70 | 1.60 | 0.80 | 0.57 | — | — | ○ | PRESENT INVENTION EX. |
| 6 | 38933 | 11 | 0.70 | 1.60 | 0.80 | 0.57 | — | — | ○ | COMP. EX. |
| 7 | 53815 | 8 | 0.80 | 1.70 | 0.78 | 0.53 | — | — | ○ | PRESENT INVENTION EX. |
| 8 | 33769 | 10 | 0.80 | 1.70 | 0.78 | 0.53 | — | — | ○ | COMP. EX. |
| 9 | 54513 | 12 | 0.90 | 1.10 | 0.79 | 0.60 | — | — | ○ | PRESENT INVENTION EX. |
| 10 | 27958 | 11 | 0.90 | 1.10 | 0.79 | 0.60 | — | — | ○ | COMP. EX. |
| 11 | 28958 | 11 | 0.90 | 1.10 | 0.79 | 0.60 | — | — | ○ | COMP. EX. |
| 12 | 53514 | 10 | 0.70 | 1.80 | 0.76 | 0.55 | — | — | ○ | PRESENT INVENTION EX. |
| 13 | 14107 | 10 | 0.70 | 1.80 | 0.76 | 0.55 | — | — | ○ | COMP. EX. |
| 14 | 62512 | 9 | 1.00 | 1.20 | 0.76 | 0.59 | — | — | ○ | PRESENT INVENTION EX. |
| 15 | 51224 | 10 | 1.00 | 1.20 | 0.76 | 0.59 | — | — | ○ | PRESENT INVENTION EX. |
| 16 | 50578 | 10 | 0.50 | 1.40 | 0.81 | 0.51 | — | — | ○ | PRESENT INVENTION EX. |
| 17 | 62785 | 9 | 0.75 | 1.30 | 0.80 | 0.58 | — | — | ○ | PRESENT INVENTION EX. |
| 18 | 46801 | 11 | 0.72 | 1.30 | 0.77 | 0.58 | — | — | ○ | PRESENT INVENTION EX. |
| 19 | 67651 | — | — | — | — | — | 0.20 | 0.30 | ○ | PRESENT INVENTION EX. |
| 20 | 62899 | 12 | 1.02 | 1.31 | 0.70 | 0.51 | — | — | ○ | PRESENT INVENTION EX. |
| 21 | 50544 | 11 | 0.60 | 1.10 | 0.79 | 0.57 | 0.10 | 0.40 | ○ | PRESENT INVENTION EX. |
| 22 | 59651 | — | — | — | — | — | — | — | ○ | PRESENT INVENTION EX. |
| 23 | 52152 | 9 | 1.50 | 1.20 | 0.77 | 0.58 | — | — | ○ | PRESENT INVENTION EX. |
| 24 | 58998 | 10 | 0.70 | 1.20 | 0.73 | 0.56 | — | — | ○ | PRESENT INVENTION EX. |
| 25 | 45663 | 11 | 1.05 | 1.60 | 0.78 | 0.55 | — | — | ○ | PRESENT INVENTION EX. |
| 26 | 42310 | 11 | 1.10 | 1.80 | 0.77 | 0.56 | — | — | ○ | COMP. EX. |
| 27 | 39934 | 12 | 0.40 | 1.40 | 0.77 | 0.53 | — | — | ○ | COMP. EX. |
| 28 | 37028 | 10 | 0.70 | 2.00 | 0.85 | 0.55 | — | — | ○ | COMP. EX. |
| 29 | 35670 | 8 | 0.95 | 0.25 | 0.77 | 0.57 | — | — | ○ | COMP. EX. |

UNDER LINE PORTION: CONDITION OUT OF THE PRESENT INVENTION

* EX.: EXAMPLE/COMP.: COMPARATIVE

As apparent from the above results, when our requirements are satisfied, a high-strength galvanized steel sheet having excellent formability in which the tensile strength is 780 MPa or more, the product of the tensile strength and the total elongation is 15,000 MPa·% or more, and the product of the tensile strength and the hole expansion rate is 45,000 MPa·% or more can be manufactured. In addition, when the requirements defined in claim 8 or 9 are satisfied, the anti-powdering property is superior.

Industrial Applicability

A high-strength galvanized steel sheet can be used, for example, in automobile and electrical industrial fields, as a high-strength galvanized steel sheet which is used for parts required to satisfy the reduction in thickness and to have the corrosion resistance. A method for manufacturing a high-strength galvanized steel sheet can be used as a method for manufacturing the above high-strength galvanized steel sheet.

The invention claimed is:

1. A high-strength galvanized steel sheet having excellent formability, comprising, as a chemical component of steel on a mass percent basis: 0.05% to 0.3% of C; more than 0.60% to 2.0% of Si; 0.50% to 3.50% of Mn; 0.003% to 0.100% of P; 0.010% or less of S; 0.010% to 0.06% of Al; 0.007% or less of N; and the balance including Fe and inevitable impurities, wherein a standard deviation of nano-hardness of the steel sheet's microstructure is 1.50 GPa or less and the steel sheet has a total area fraction of retained austenite and martensite of 5% or less.

2. The high-strength galvanized steel sheet according to claim 1, wherein the chemical component of steel further comprises at least one of 0.005% to 2.00% of Cr, 0.005% to 2.00% of V, 0.005% to 2.00% of Mo, 0.005% to 2.00% of Ni, and 0.005% to 2.00% of Cu on a mass percent basis.

3. The high-strength galvanized steel sheet according to claim 1, wherein the chemical component of steel further comprises at least one of 0.01% to 0.20% of Ti and 0.01% to 0.10% of Nb on a mass percent basis.

4. The high-strength galvanized steel sheet according to claim 1, wherein the chemical component of steel further comprises 0.0002% to 0.005% of B on a mass percent basis.

5. The high-strength galvanized steel sheet according to claim 1, wherein the chemical component of steel further comprises at least one of 0.001% to 0.005% of Ca and 0.001% to 0.005% of REM on a mass percent basis.

6. The high-strength galvanized steel sheet according to claim 1, wherein an average solid-solved Si amount and an average solid-solved Mn amount in a base steel surface layer portion, which is in a region from a plating/base steel interface to a depth of 0.5 μm therefrom, are each 0.5 mass percent or less.

7. The high-strength galvanized steel sheet according to claim 1, further comprising a plating layer containing 7% to 15% of Fe, and having in a base steel surface layer portion, which is in a region from a plating/base steel interface to a depth of 0.5 μm therefrom, an average solid-solved Si amount of 70% to 90% of a Si amount of an average parent material composition, and an average solid-solved Mn amount of 50% to 90% of an Mn amount of the average parent material composition.

8. A high-strength galvanized steel sheet having excellent formability, comprising, as a chemical component of steel on a mass percent basis: 0.05% to 0.3% of C; more than 0.60% to 2.0% of Si; 0.50% to 3.50% of Mn; 0.003% to 0.100% of P; 0.010% or less of S; 0.010% to 0.06% of Al; 0.007% or less of N; and the balance including Fe and inevitable impurities, wherein the steel sheet has a microstructure of ferrite in an area fraction of 20% or more; wherein tempered martensite, tempered bainite, and bainite in the steel microstructure have a total area fraction of 10% or more; wherein ferrite, tempered martensite, tempered bainite, and bainite in the steel microstructure have a total area fraction of 90% more; wherein or a standard deviation of nano-hardness of the steel sheet's microstructure is 1.50 GPa or less; and wherein the steel microstructure has a total area fraction of retained austenite and martensite of 5% or less.

9. The high-strength galvanized steel sheet according to claim 2, wherein the chemical component of steel further comprises at least one of 0.005% to 2.00% of Cr, 0.005% to 2.00% of V, 0.005% to 2.00% of Mo, 0.005% to 2.00% of Ni, and 0.005% to 2.00% of Cu on a mass percent basis.

10. The high-strength galvanized steel sheet according to claim 2, wherein the chemical component of steel further comprises at least one of 0.01% to 0.20% of Ti and 0.01% to 0.10% of Nb on a mass percent basis.

11. The high-strength galvanized steel sheet according to claim 2, wherein the chemical component of steel further comprises 0.0002% to 0.005% of B on a mass percent basis.

12. The high-strength galvanized steel sheet according to claim 8, wherein the chemical component of steel further comprises at least one of 0.001% to 0.005% of Ca and 0.001% to 0.005% of REM on a mass percent basis.

13. The high-strength galvanized steel sheet according to claim 8, wherein an average solid-solved Si amount and an average solid-solved Mn amount in a base steel surface layer portion, which is in a region from a plating/base steel interface to a depth of 0.5 μm therefrom, are each 0.5 mass percent or less.

14. The high-strength galvanized steel sheet according to claim 8, further comprising a plating layer containing 7% to 15% of Fe, and having in a base steel surface layer portion, which is in a region from a plating/base steel interface to a depth of 0.5 μm therefrom, an average solid-solved Si amount of 70% to 90% of a Si amount of an average parent material composition, and an average solid-solved Mn amount of 50% to 90% of an Mn amount of the average parent material composition.

* * * * *

UNITED STATES PATENT AND TRADEMARK OFFICE

CERTIFICATE OF CORRECTION

PATENT NO. : 8,241,759 B2
APPLICATION NO. : 12/532452
DATED : August 14, 2012
INVENTOR(S) : Nakagaito et al.

It is certified that error appears in the above-identified patent and that said Letters Patent is hereby corrected as shown below:

On the Title Page

At (75), please insert --Yoshiharu Sugimoto, Tokyo (JP)--.

In Column 24

At line 18, after "wherein" please delete "or".

Signed and Sealed this
Fifth Day of February, 2013

Teresa Stanek Rea
*Acting Director of the United States Patent and Trademark Office*